US007506564B2

(12) United States Patent
Schulze-Beckinghausen

(10) Patent No.: US 7,506,564 B2
(45) Date of Patent: Mar. 24, 2009

(54) GRIPPING SYSTEM FOR A TONG

(75) Inventor: Joerg E. Schulze-Beckinghausen, Garbsen (DE)

(73) Assignee: Weatherford/Lamb, Inc., Houston, TX (US)

( * ) Notice: Subject to any disclaimer, the term of this patent is extended or adjusted under 35 U.S.C. 154(b) by 53 days.

(21) Appl. No.: 11/080,233

(22) Filed: Mar. 15, 2005

(65) Prior Publication Data

US 2005/0188794 A1 Sep. 1, 2005

Related U.S. Application Data

(63) Continuation-in-part of application No. 10/794,792, filed on Mar. 5, 2004, now Pat. No. 7,281,451, which is a continuation-in-part of application No. 10/048,353, filed on Jun. 11, 2002, now Pat. No. 6,745,646, and a continuation-in-part of application No. 10/146,599, filed on May 15, 2002, now Pat. No. 6,814,149, which is a continuation-in-part of application No. 10/074,947, filed on Feb. 12, 2002, now Pat. No. 7,028,585.

(60) Provisional application No. 60/452,270, filed on Mar. 5, 2003.

(51) Int. Cl.
*B25B 13/50* (2006.01)
*B25B 17/00* (2006.01)

(52) U.S. Cl. ..... 81/57.33; 81/57.19; 81/57.2

(58) Field of Classification Search ..... 81/57.18–57.21, 81/57.15–57.16, 57.33–57.35, 57.24–57.25; 166/77.51

See application file for complete search history.

(56) References Cited

U.S. PATENT DOCUMENTS 1,150,178 A 8/1915 Diefendorf (Continued)

FOREIGN PATENT DOCUMENTS

DE 2 128 362 1/1972

(Continued)

OTHER PUBLICATIONS

U.K. Search Report, Application No. GB0505535.5, dated May 13, 2005.

(Continued)

*Primary Examiner*—D. S Meislin
(74) *Attorney, Agent, or Firm*—Patterson & Sheridan, LLP

(57) ABSTRACT

In one embodiment, a gripping system for a tong for making up and breaking out tubulars is provided. The gripping system is coupled to the rotary of the tong. The gripping system includes an active jaw and two passive jaws disposed interior to the rotary. Preferably, the two passive jaws are separately by less than 120 degrees from each other and are pivotally connected to rotary. The gripping system is adapted and arranged to allow each passive jaw to react the same amount of force as the gripping force applied by the active jaw. In another embodiment, a rotary locking apparatus is provided to lock or unlock the rotary of the tong.

21 Claims, 6 Drawing Sheets

U.S. PATENT DOCUMENTS

| | | | |
|---|---|---|---|
| 2,259,275 | A | 10/1941 | Stone, Jr. |
| 2,297,833 | A | 10/1942 | Johansson |
| 2,390,568 | A | 12/1945 | Witherspoon |
| 2,522,444 | A | 9/1950 | Grable |
| 2,566,561 | A | 9/1951 | Edelberg |
| 2,566,651 | A | 9/1951 | Bernis |
| 2,610,690 | A | 9/1952 | Beatty |
| 2,639,894 | A | 5/1953 | Smith |
| 2,950,639 | A | 8/1960 | Mason |
| 3,021,739 | A | 2/1962 | Grundmann |
| 3,041,901 | A | 7/1962 | Knights |
| 3,086,413 | A | 4/1963 | Mason |
| 3,122,811 | A | 3/1964 | Gilreath |
| 3,131,586 | A | 5/1964 | Wilson |
| 3,180,186 | A | 4/1965 | Catland |
| 3,220,245 | A | 11/1965 | Van Winkle |
| 3,302,496 | A | 2/1967 | Mitchell et al. |
| 3,349,455 | A | 10/1967 | Doherty |
| 3,443,291 | A | 5/1969 | Doherty |
| 3,475,038 | A | 10/1969 | Matherne |
| 3,518,903 | A | 7/1970 | Ham et al. |
| 3,559,739 | A | 2/1971 | Hutchison |
| 3,606,664 | A | 9/1971 | Weiner |
| 3,680,412 | A | 8/1972 | Mayer et al. |
| 3,722,331 | A | 3/1973 | Radulescu |
| 3,747,675 | A | 7/1973 | Brown |
| 3,796,418 | A | 3/1974 | Carlberg |
| 3,808,916 | A | 5/1974 | Porter et al. |
| 3,838,613 | A | 10/1974 | Wilms |
| 3,902,385 | A | 9/1975 | Haby |
| 3,933,108 | A | 1/1976 | Baugh |
| 3,941,348 | A | 3/1976 | Mott |
| 3,986,564 | A | 10/1976 | Bender |
| 4,005,621 | A | 2/1977 | Turner, Jr. et al. |
| 4,023,449 | A | 5/1977 | Boyadjieff |
| 4,142,739 | A | 3/1979 | Billingsley |
| 4,147,215 | A | 4/1979 | Hodge et al. |
| 4,159,637 | A | 7/1979 | Lamb et al. |
| 4,170,908 | A | 10/1979 | Peveto et al. |
| 4,202,225 | A | 5/1980 | Sheldon et al. |
| 4,215,602 | A | 8/1980 | Carstensen et al. |
| 4,221,269 | A | 9/1980 | Hudson |
| 4,246,809 | A | 1/1981 | Keast et al. |
| 4,257,422 | A | 3/1981 | Duncan |
| 4,262,693 | A | 4/1981 | Giebeler |
| 4,280,380 | A | 7/1981 | Eshghy |
| 4,291,762 | A | 9/1981 | Gudgel |
| 4,295,527 | A | 10/1981 | Russe |
| 4,315,553 | A | 2/1982 | Stallings |
| 4,334,444 | A | 6/1982 | Carstensen et al. |
| 4,346,629 | A | 8/1982 | Kinzbach |
| 4,401,000 | A | 8/1983 | Kinzbach |
| 4,402,239 | A | 9/1983 | Mooney |
| 4,403,666 | A | 9/1983 | Willis |
| 4,442,736 | A | 4/1984 | True et al. |
| 4,442,892 | A | 4/1984 | Delesandri |
| RE31,669 | E | 9/1984 | Eigenmann |
| RE31,699 | E | 10/1984 | Eckel |
| 4,492,134 | A | 1/1985 | Reinholdt et al. |
| 4,497,224 | A | 2/1985 | Jurgens |
| 4,499,919 | A | 2/1985 | Forester |
| 4,565,003 | A | 1/1986 | McLeod |
| 4,572,036 | A | 2/1986 | Renfro |
| 4,573,359 | A | 3/1986 | Carstensen |
| 4,592,125 | A | 6/1986 | Skene |
| 4,593,773 | A | 6/1986 | Skeie |
| 4,643,259 | A | 2/1987 | Zeringue, Jr. |
| 4,648,292 | A | 3/1987 | Haynes et al. |
| 4,649,777 | A | 3/1987 | Buck |
| 4,709,766 | A | 12/1987 | Boyadjieff |
| 4,712,284 | A | 12/1987 | Coyle, Sr. et al. |
| 4,715,625 | A | 12/1987 | Shows, Jr. et al. |
| 4,732,373 | A | 3/1988 | Yang |
| 4,738,145 | A | 4/1988 | Vincent et al. |
| 4,773,218 | A | 9/1988 | Wakita et al. |
| 4,811,635 | A | 3/1989 | Falgout, Sr. |
| 4,821,814 | A | 4/1989 | Willis et al. |
| 4,867,236 | A | 9/1989 | Haney et al. |
| 4,869,137 | A | 9/1989 | Slator |
| 4,895,056 | A | 1/1990 | Schulze-Beckinghausen |
| 4,938,109 | A | 7/1990 | Torres et al. |
| 4,969,638 | A | 11/1990 | Yang |
| 4,979,356 | A | 12/1990 | Vatne |
| 5,000,065 | A | 3/1991 | Haynes |
| 5,022,472 | A | 6/1991 | Bailey et al. |
| 5,044,232 | A | 9/1991 | Schulze-Beckinghausen |
| 5,054,550 | A | 10/1991 | Hodge |
| 5,081,888 | A | 1/1992 | Schulze-Beckinghausen |
| 5,092,399 | A | 3/1992 | Lang |
| RE34,063 | E | 9/1992 | Vincent et al. |
| 5,150,642 | A | 9/1992 | Moody et al. |
| 5,159,860 | A | 11/1992 | Pietras |
| 5,161,438 | A | 11/1992 | Pietras |
| 5,167,173 | A | 12/1992 | Pietras |
| 5,172,613 | A | 12/1992 | Wesch, Jr. |
| 5,209,302 | A | 5/1993 | Robichaux et al. |
| 5,221,099 | A | 6/1993 | Jansch |
| 5,245,265 | A | 9/1993 | Clay |
| 5,451,084 | A | 9/1995 | Jansch |
| 5,520,072 | A | 5/1996 | Perry |
| 5,542,318 | A | 8/1996 | Wesch, Jr. |
| 5,634,671 | A | 6/1997 | Watkins |
| 5,667,026 | A | 9/1997 | Lorenz et al. |
| 5,706,893 | A | 1/1998 | Morgan |
| 5,730,471 | A | 3/1998 | Schulze-Beckinghausen et al. |
| 5,746,276 | A | 5/1998 | Stuart |
| 5,787,982 | A | 8/1998 | Bakke |
| 5,819,605 | A | 10/1998 | Buck et al. |
| 5,839,330 | A | 11/1998 | Stokka |
| 5,842,390 | A | 12/1998 | Bouligny et al. |
| 5,845,549 | A | 12/1998 | Bouligny |
| 5,890,549 | A | 4/1999 | Sprehe |
| 5,992,801 | A | 11/1999 | Torres |
| 5,996,444 | A | 12/1999 | Pearce et al. |
| 6,047,775 | A | 4/2000 | Mock |
| 6,065,372 | A | 5/2000 | Rauch |
| 6,082,224 | A | 7/2000 | McDaniels et al. |
| 6,082,225 | A | 7/2000 | Richardson |
| 6,116,118 | A | 9/2000 | Wesch, Jr. |
| 6,119,772 | A | 9/2000 | Pruet |
| 6,138,529 | A | 10/2000 | Pietras |
| 6,142,041 | A | 11/2000 | Buck |
| 6,161,617 | A | 12/2000 | Gjedebo |
| 6,206,096 | B1 | 3/2001 | Belik |
| 6,223,629 | B1 | 5/2001 | Bangert |
| 6,253,845 | B1 | 7/2001 | Belik |
| 6,276,238 | B1 | 8/2001 | Junck et al. |
| 6,276,328 | B1 | 8/2001 | Denton et al. |
| 6,305,720 | B1 | 10/2001 | Spiering et al. |
| 6,315,051 | B1 | 11/2001 | Ayling |
| 6,327,938 | B1 | 12/2001 | Pietras |
| 6,330,911 | B1 | 12/2001 | Allen et al. |
| 6,360,633 | B2 | 3/2002 | Pietras |
| 6,374,706 | B1 | 4/2002 | Newman |
| 6,412,554 | B1 | 7/2002 | Allen et al. |
| 6,480,811 | B2 | 11/2002 | Denny et al. |
| 6,598,501 | B1 | 7/2003 | Schulze-Beckinghausen et al. |
| 6,634,259 | B2 | 10/2003 | Castille |
| 6,668,684 | B2 | 12/2003 | Allen et al. |
| 6,684,737 | B1 | 2/2004 | Schulze-Beckinghausen et al. |
| 6,761,090 | B2 * | 7/2004 | Dagenais et al. ..... 81/57.18 |
| 7,090,254 | B1 | 8/2006 | Pietras et al. |
| 2002/0157823 | A1 | 10/2002 | Pietras et al. |

| | | | | |
|---|---|---|---|---|
| 2003/0075023 | A1 | 4/2003 | Robichaux | |
| 2003/0177870 | A1* | 9/2003 | Neves et al. | 81/57.2 |
| 2004/0035573 | A1 | 2/2004 | Pietras | |
| 2004/0049905 | A1 | 3/2004 | Jansch et al. | |
| 2004/0237726 | A1 | 12/2004 | Schulze-Beckinghausen | |
| 2005/0077743 | A1 | 4/2005 | Pietras et al. | |

FOREIGN PATENT DOCUMENTS

| | | |
|---|---|---|
| DE | 3523221 | 2/1987 |
| EP | 0 087 373 | 8/1983 |
| EP | 0 285 386 | 10/1988 |
| EP | 0 311 455 | 4/1989 |
| EP | 0 339 005 | 10/1989 |
| EP | 0 423 055 | 4/1991 |
| EP | 0 525 247 | 2/1993 |
| GB | 804798 | 11/1958 |
| GB | 1 215 967 | 12/1970 |
| GB | 2 049 518 | 12/1980 |
| GB | 2 115 940 | 9/1983 |
| GB | 2 128 526 | 5/1984 |
| GB | 2 246 577 | 2/1992 |
| GB | 2 300 896 | 11/1996 |
| GB | 2 346 576 | 8/2000 |
| GB | 2 352 667 | 2/2001 |
| WO | WO 83/03443 | 10/1983 |
| WO | WO 92/18744 | 10/1992 |
| WO | WO 93/18276 | 9/1993 |
| WO | WO 95/20471 | 8/1995 |
| WO | WO 98/16716 | 4/1998 |
| WO | WO 98/32948 | 7/1998 |
| WO | WO 99/34089 | 7/1999 |
| WO | WO 99/34090 | 7/1999 |
| WO | WO 99/34091 | 7/1999 |
| WO | WO 00/22278 | 4/2000 |
| WO | WO 00/23686 | 4/2000 |
| WO | WO 00/45026 | 8/2000 |
| WO | WO 00/45027 | 8/2000 |
| WO | WO 00/61906 | 10/2000 |
| WO | WO 00/74899 | 12/2000 |
| WO | WO 00/79092 | 12/2000 |
| WO | WO 01/03889 | 1/2001 |
| WO | WO 01/09479 | 2/2001 |
| WO | WO 01/38688 | 5/2001 |
| WO | WO 01/66905 | 9/2001 |
| WO | WO 01/81047 | 11/2001 |
| WO | WO 02/04173 | 1/2002 |

OTHER PUBLICATIONS

GB Search Report, Application No. GB0505535.5, dated Jul. 12, 2007.

GB Search Report, Application No. GB0718374.2, Nov. 28, 2007.

* cited by examiner

GRIPPING SYSTEM FOR A TONG

CROSS-REFERENCE TO RELATED APPLICATIONS

This application claims benefit of co-pending U.S. Provisional Patent Application Ser. No. 60/554,077, filed on Mar. 17, 2004, which application is herein incorporated by reference in its entirety.

This application is a continuation-in-part of U.S. patent application Ser. No. 10/794,792, filed on Mar. 5, 2004 now U.S. Pat. No. 7,281,451, which application (1) claims benefit of U.S. provisional patent application Ser. No. 60/452,270, filed Mar. 5, 2003; (2) is a continuation-in-part of U.S. patent application Ser. No. 10/048,353, filed Jun. 11, 2002, now U.S. Pat. No. 6,745,646; and (3) is a continuation-in-part of co-pending U.S. patent application Ser. No. 10/146,599, filed May 15, 2002, now U.S. Pat. No. 6,814,149, which, in turn, is a continuation-in-part of U.S. patent application Ser. No. 10/074,947, filed Feb. 12, 2002, now U.S. Pat. No. 7,028,585. All of the above referenced applications are herein incorporated by reference in their entirety.

BACKGROUND OF THE INVENTION

1. Field of the Invention

The present invention relates to apparatus for making up and breaking out tubular connections. Particularly, the present invention relates to a gripping system for an apparatus for making and breaking tubular connections. The present invention also relates to a locking apparatus for a rotary.

2. Description of the Related Art

Oilfield tubulars such as drill pipe and casing are employed in sections which are joined together at their ends by threaded connections. Typically, power tools are used to couple ("make up") or decouple ("break out") threaded connections. Power tools such as tong assemblies have been developed to threadably secure tubulars together.

A tong assembly generally includes a power tong and a backup tong. The power tong is associated with a power drive to grip and apply torque to a first tubular to cause it to rotate. The backup tong is adapted to grip second tubular during engagement between the tubulars. The backup tong typically maintains the second tubular in a stationary position, thereby allowing relative rotation between the first and second tubulars. The backup tong may also allow some radial or axial displacement between the tubulars to accommodate deviations between the shapes of the tubulars during makeup.

The power tools generally used to connect tubulars are adapted and designed to provide the appropriate torque to achieve proper threaded connection. The threads may become damaged or stripped when excessive force is applied. Typically, the power tongs are provided with torque gauges to prevent damage to the threads. In many arrangements, hydraulic power is used to operate the power tool.

Many different gripping systems are known to be used for a tong. In one example, the tong may only have one powered jaw. In this system, the "active" jaw is a cam driven master jaw and the remaining "passive" jaws react to the forces of the active jaw. In some instances, the passive jaws may only react 50% of the gripping force applied by the active jaw, as illustrated in FIG. 1. In this situation, the load will not be equally displaced between the jaws, e.g., the active jaw supplies 10 ton, while each of the passive jaws only react 5 tons.

In order to make up or break out a connection between tubulars in a tubular string, torque must be supplied over a large angle without having to take time to release and clamp the tubular again. For some jaw assemblies, the torque of the rotor enters the active jaw through a roller disposed at the back of the active jaw. When a small diameter tubular is handled, the active jaw may swivel to cause the gripping force to offset, thereby by damaging the pipe surface. It is also known that when used at high torques, some jaw assemblies tend to tilt and provide a non-uniform load on the tubular surfaces. When the jaw assembly tilts, only a portion of the jaw assembly contacts the tubular, thereby causing damage to the tubular, limiting the torque that can be applied, and causing failure of the jaw assembly itself.

There is a need, therefore, for a gripping system having a passive jaw adapted to transmit a reactive force that is equivalent to the gripping force applied by the active jaw. There is also a need for an improved gripping system for transferring torque to the tubular. There is a further need to prevent rotation of the rotary when it is open.

SUMMARY OF THE INVENTION

Apparatus and methods for handling a tubular are provided. In one embodiment, a tong includes a gripping system coupled to a rotary for applying torque thereto. The gripping system includes an active jaw and two passive jaws disposed interior to the rotary. Preferably, the two passive jaws are separately by less than 120 degrees from each other and are pivotally connected to rotary. The gripping system is adapted and arranged to allow each passive jaw to react the same amount of force as the gripping force applied by the active jaw.

In another embodiment, a gripping apparatus includes a housing for receiving the tubular and a plurality of gripping members disposed in the housing for gripping the tubular, wherein at least one of the plurality of gripping members are pivotally coupled to the housing.

In another embodiment, a method for handling a tubular is provided. The method comprises providing a gripping apparatus having a plurality of gripping members coupled to a rotary, pivoting at least one of the plurality of gripping members relative to the rotary, gripping the tubular, and applying torque to rotate the tubular. In another embodiment, the method also includes providing the rotary with a locking member and providing a locking apparatus for moving the locking member between an open position and a closed position. In another embodiment, the locking apparatus includes a coupling element for engaging the locking member and an actuator for moving the coupling element.

In another embodiment, an apparatus for handling a tubular is provided. The apparatus includes a gripping member having a rotary and a locking member for locking the rotary. The apparatus also includes a rotary locking apparatus having a coupling element for engaging the locking member and an actuator for moving the locking member between an open position and a closed position. In another embodiment, the apparatus further includes a carrier attached to the coupling element and coupled to the actuator. In another embodiment still, the rotation of the actuator moves the coupling element and the locking element between the open position and the closed position. In another embodiment still, the coupling element comprises a magnet.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

In one embodiment, a tong includes a gripping system coupled to a rotary for applying torque thereto. The gripping system includes an active jaw and two passive jaws disposed interior to the rotary. The passive jaws are pivotally connected to rotary. Preferably, the two passive jaws are separately by less than 120 degrees from each other. The gripping system is adapted and arranged to allow each passive jaw to react a force equivalent to the gripping force applied by the active jaw.

Figure 2:
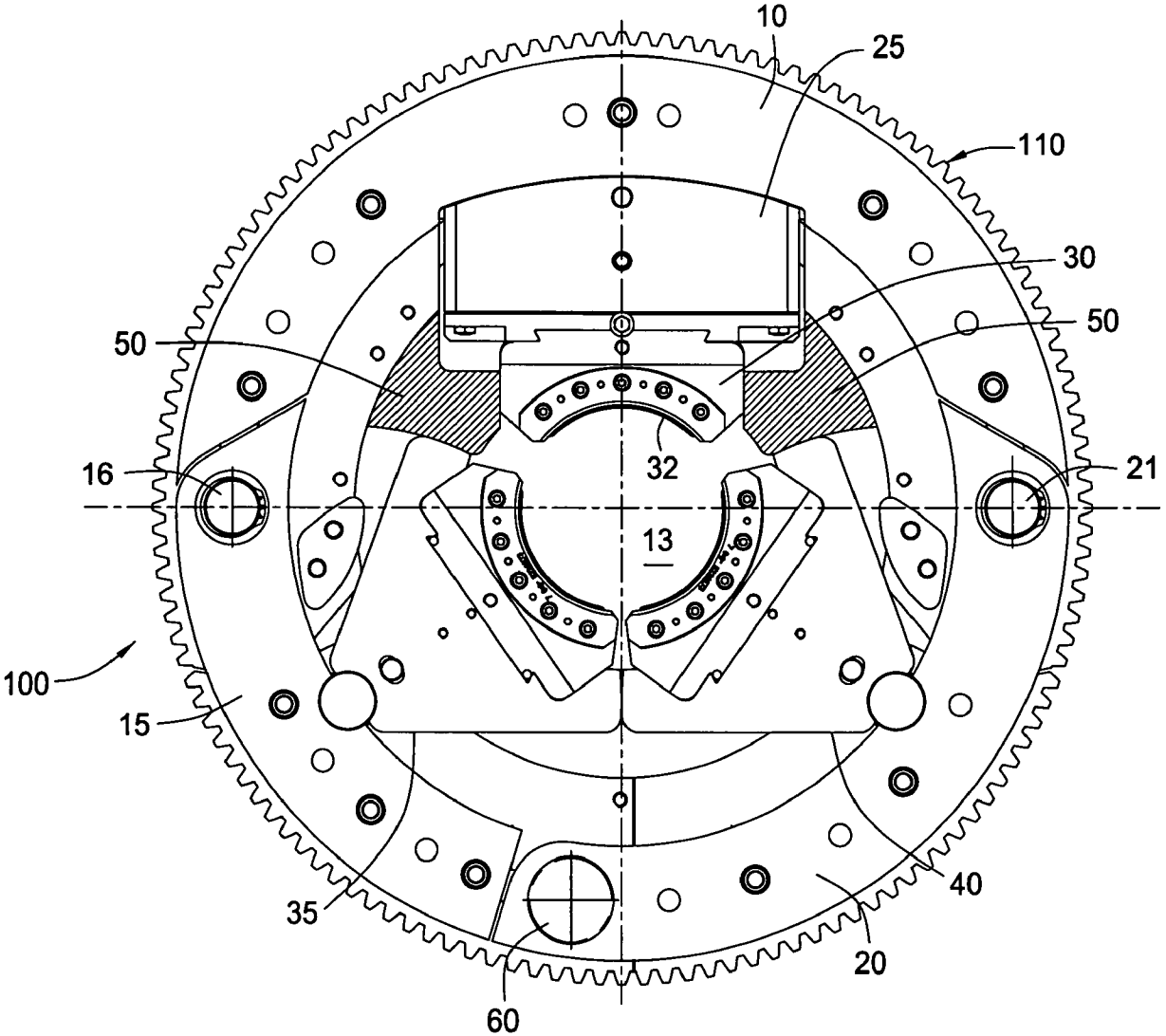
FIG. 2 shows a gripping system for a tong having pivotable passive jaws.

FIG. 2 shows an exemplary tong 100 applicable for handling a tubular. The tong 100 includes a rotary 110 having a body portion 10 coupled to an arm portion 15, 20 at each end. One end of each arm portion 15, 20 is hinged to the body portion 10 using a hinge connection 16, 21, and the other end is latchable to the other arm portion 15, 20 using a rotor lock 60. When latched, i.e., closed, the body portion 10 and the arm portions 15, 20 define a bore 13 therethrough for retaining a tubular 5. Also, the arm portions 15, 20 may open by pivoting outward, thereby enabling the tubular 5 to pass between the arm portions 15, 20 and enter the bore 13. Examples of suitable tubulars include drill pipe, casing, liner, tubing, and other types of downhole tubulars as is known in the art. Each arm portion 15, 20 may be connected to a drive mechanism such as a piston adapted to pivot the arm portion 15, 20 between the open and closed positions.

The gripping system is coupled to the interior of the rotary 110. In one embodiment, the gripping system includes an active jaw 30 adapted to apply a gripping force and two passive jaws 35, 40 adapted to provide a reactive force. The contact surface of the jaws 30 may include a gripping element 32 such as teeth or inserts for frictional contact with the tubular 5. Additionally, adapters may be added to the jaws for engagement with tubulars of various diameters.

As shown in FIG. 2, the active jaw 30 is operatively coupled to the body portion 10. In one embodiment, the active jaw 30 is fluidly operated by a hydraulic cylinder 25. The hydraulic cylinder 25 is at least partially disposed in the rotary 110 and may be actuated to move the active jaw 30 radially into or out of engagement with the tubular 5. In another embodiment (not shown), the active jaw 30 is driven by a cam coupled to the body portion 10. When the body portion 10 is rotated, the active jaw 30 is caused to grip the tubular 5.

Each of the passive jaws 35, 40 is coupled to an arm portion 15, 20. In this respect, the passive jaws 35, 40 may be opened or closed by activation of the arm portions 15, 20, thereby allowing the passive jaws 35, 40 to receive or engage the tubular 5 as necessary. Preferably, the passive jaws 35, 40 are located at or less than 120 degrees from each other and equidistant from the active jaw 30. The front of the passive jaws 35, 40 is adapted to grip the tubular 5, while the back is movably connected to the respective arm portion 15, 20. The passive jaws 35, 40 are adapted to pivot relative to the arm portions 15, 20 so that maximum contact with the tubular 5 may be achieved. When all of the jaws 30, 35, 40 are gripping the tubular 5, the pivotal connection allows the passive jaws 35, 40 to self adjust so that it can provide a reactive force that is equal to the applied gripping force from the active jaw 30. Because all of the jaws 30, 35, 40 apply the same force, the load will be equally displaced. In one embodiment, the sides of the passive jaws 35, 40 located away from the active jaw 30 are in contact with each other when the jaws 30, 35, 40 are engage with the tubular 5. In this respect, the passive jaws 35, 40 may support one another during activation.

In one embodiment, movement of the jaws 30, 35, 40 is guided by guiding elements 50 disposed between the jaws 30, 35, 40. As shown in FIG. 2, a guiding element 50 is disposed on each side of the active jaw 30 and attached to the body portion 10 of the rotary 110. When the jaws 30, 35, 40 are engaged with the tubular 5, each guiding element 50 are in contact with the active jaw 30 and the adjacent passive jaw 35, 40. Preferably, the side face of the guiding element 50 in contact with the respective passive jaw 35, 40 is contoured to accommodate the pivotal movement of the passive jaw 35, 40. The torque from the rotary 110 is introduced to the jaws 30, 35, 40 through the guiding elements 50. When the rotary 110 is closed, the jaws 30, 35, 40 and the guiding elements 50 laterally support one another through a 360° closed circle such that corresponding torque from the rotary 110 is transmitted to the tubular only in a tangential direction. The closed arrangement effectively locks the jaws 30, 35, 40 and the guiding elements 50 in place, thereby minimizing the swivel effect of the jaws 30, 35, 40. Thus, the applied load distributes equally on the tubular 5.

Figure 3:
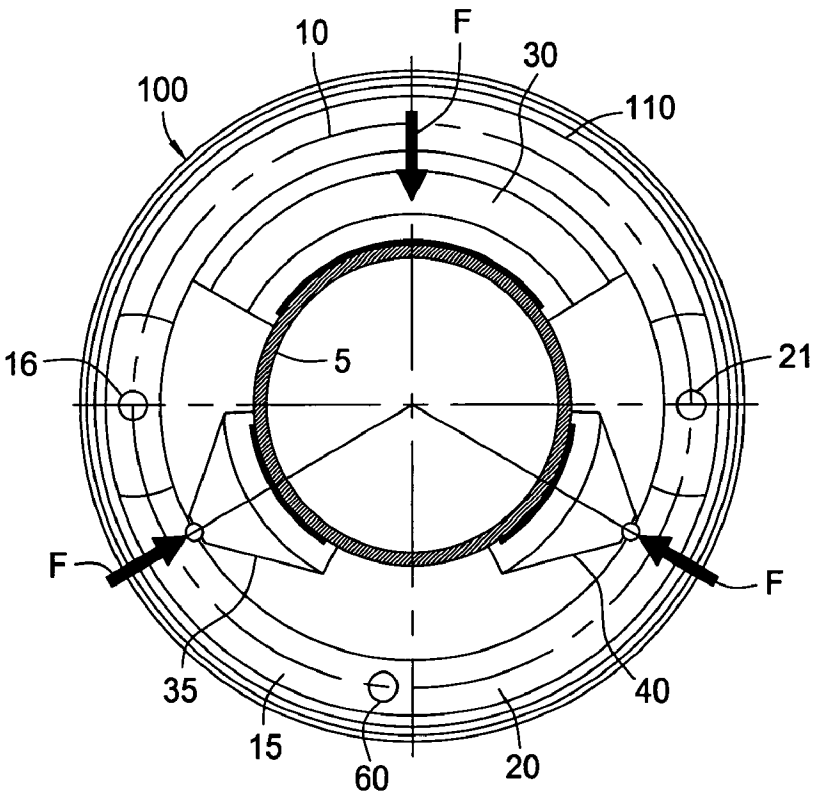
FIG. 3 is a schematic representation of the gripping system of FIG. 2.
Figure 1:
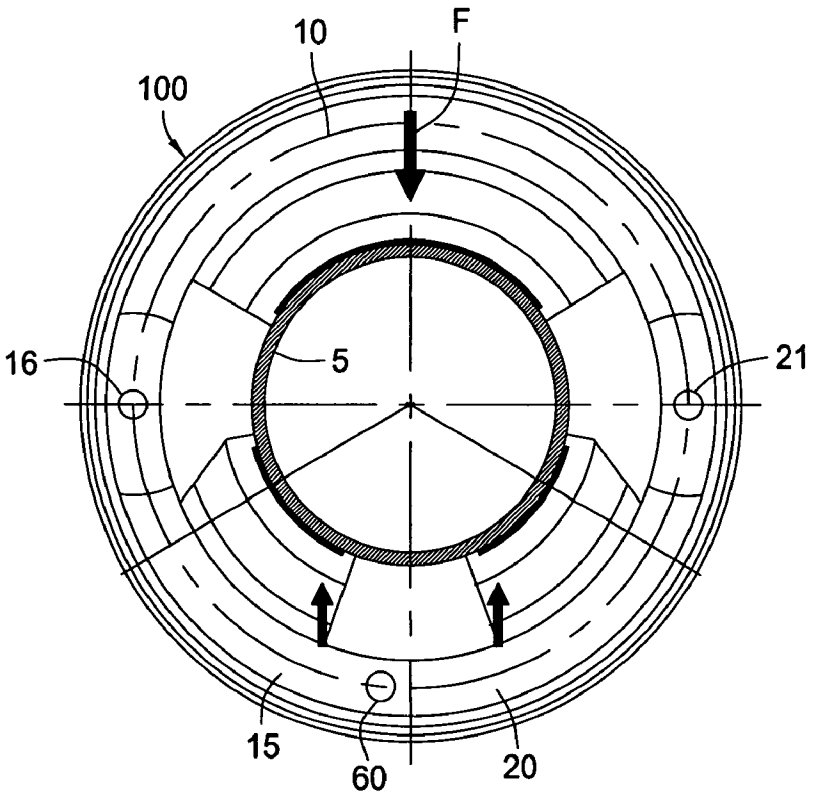
FIG. 1 shows a gripping system for a tong whose passive jaws each react 50% of the applied force.

In operation, the arms portions 15, 20 are unlatch and opened to receive a tubular 5. Once the arm portions 15, 20 are closed, the active jaw 30 is caused to move radially into contact with the tubular 5. Even after contact is established, the active jaw 30 continues to push the tubular 5 toward the two passive jaws 35, 40 until the tubular 5 is fully gripped by the three jaws 30, 35, 40. In this respect, the passive jaws 35, 40, which may only partially engage the tubular 5 upon initial contact with the tubular 5, will adjust itself about the pivotal connection with the arm portion 15, 20 until maximum contact is achieved. Preferably, the passive jaws 35, 40 are aligned such that the reactive force is directed towards the center of the tubular 5, as shown by the force arrows F in FIG. 3.

Thereafter, the rotary 110 is rotated to transfer torque to the jaws 30, 35, 40 to rotate the tubular 5. The torque is transferred to all jaws 30, 35, 40 through the guiding elements 50. The 360° closed contact between the jaws 30, 35, 40 and the guiding elements 50 reduces or eliminates the swivel effect on the jaws 30, 35, 40. In this manner, the gripping system allows the passive jaws 35, 40 to react the entire gripping force applied by the active jaw 30.

Figure 4:
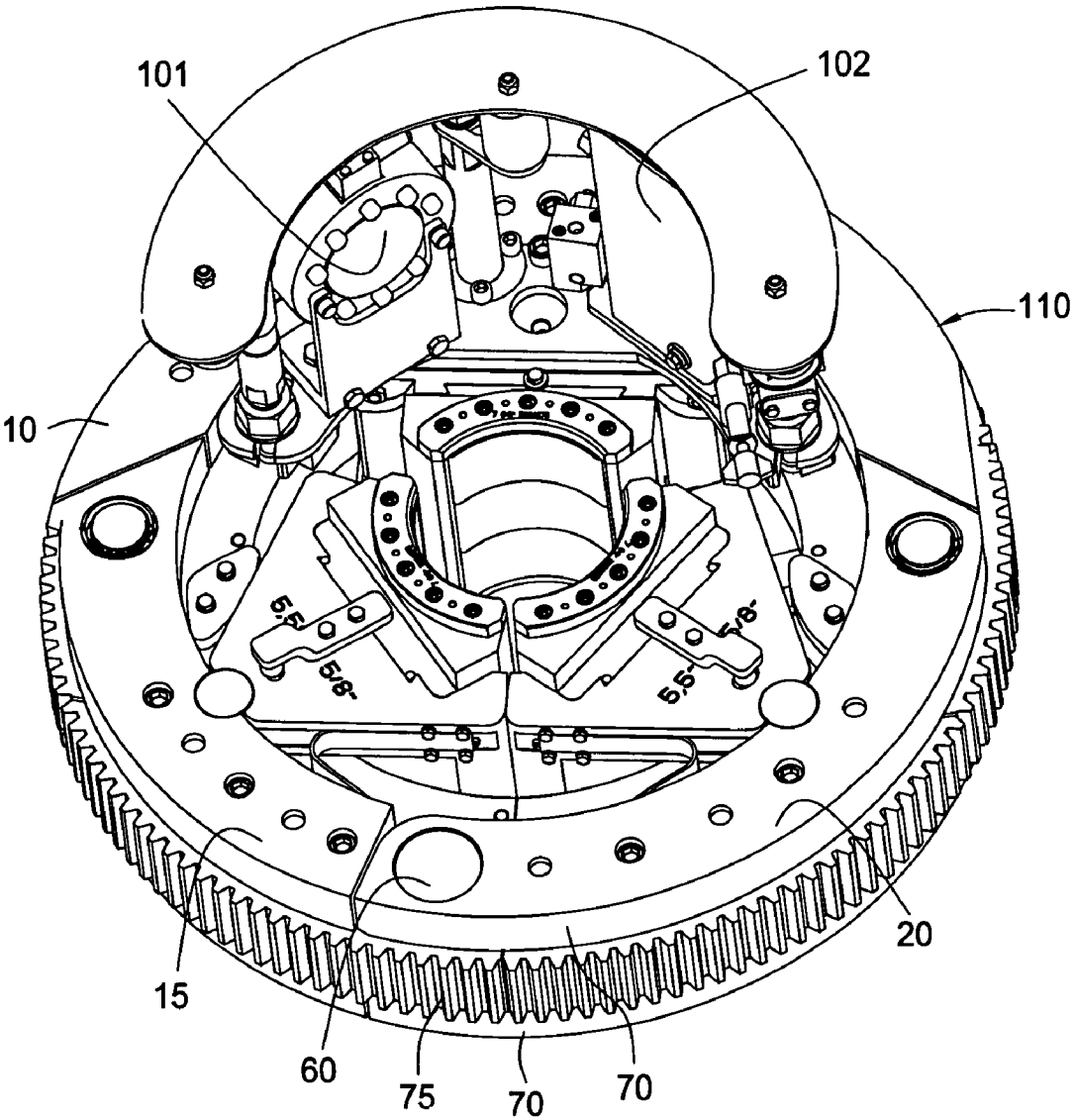
FIG. 4 shows a fluid operated gripping system.

In another embodiment, a rotor locking apparatus is provided to prevent premature rotation of the rotary prior to its closing. FIG. 4 shows a rotary 110 having a hydraulic drive gripping system. The rotary 110 is shown with a pump 101 and tank 102 attached. The pump supplies fluid to the motor (not shown). The rotary 110 has a body portion 10 and two arm portions 15, 20. In the closed position as shown, the two arm portions 15, 20 are latched together. In one embodiment, one arm portion 15 includes a rotor extension 75 and the other arm portion 20 includes a corresponding rotor groove 70. Apertures are provided in the rotor extension 75 and the rotor groove 70 such that the apertures are aligned to receive a rotor lock 60 when the rotary 110 is closed. In FIG. 4, the rotor lock 60 is shown inserted through the apertures, thereby locking the rotary 110 in the closed position.

Figure 5:
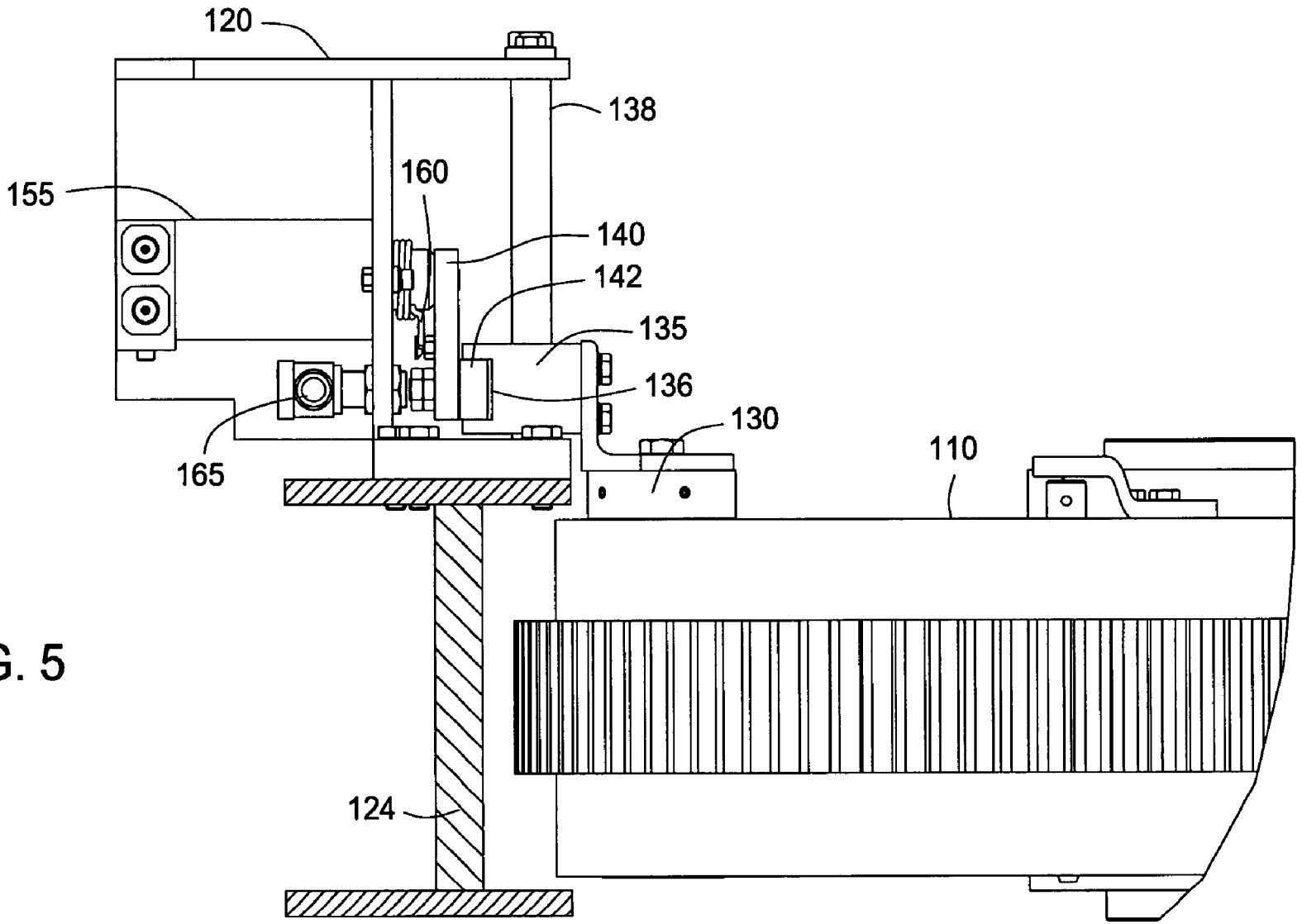
FIG. 5 shows a rotary locking apparatus for locking or unlocking the gripping system of FIG. 4.

FIG. 5 illustrates an exemplary rotor locking apparatus 120 adapted to move the rotor lock 60 into and out of the apertures. The rotor locking apparatus 120 is positioned adjacent the rotor lock 60 and attached to the tong housing 124. The rotor locking apparatus 120 includes a magnet 130 attached to a carrier 135 and an actuator 140 for moving the carrier 135 along two shafts 138. The magnet 130 acts as a coupling element for engaging an upper portion of the rotor lock 60 and for moving the rotor lock 60 in and out of the apertures. Preferably, the upper portion of the rotor lock 60 includes a contact plate 61 that extends slightly above the rotary 110. The actuator 140 and the carrier 135 are coupled such that rotation of the actuator 140 causes the carrier 135 to move along the shafts 138, thereby lifting or lowering the magnet 130. In one embodiment, the actuator 140 is a lever arm and includes a roller 142 that engages a slot 136 in the back of the carrier 135. During rotation of the actuator 140, the roller 142 is allowed to move in the slot 136 while the carrier 135 is raised or lowered. Because the actuator 140 is rotated to move the carrier 135, the speed of the magnet 130 follows a sine curve, where the magnet 130 is slowest at the beginning and the end of the actuator movement, and the magnet 130 is fastest when the actuator 140 is 90 degrees from the shafts 138. A motor 155, such as a hydromotor, may be used to rotate the actuator 140. Preferably, the motor 155 is adapted to move the actuator 140 in 180 degree cycles to lift or lower the magnet 130.

The rotor locking apparatus 120 may also be provided with an offset member 160. The offset member 160 is adapted to position the magnet 130 above its lowermost position when the magnet 130 is not engaged with the rotor lock 60. An exemplary offset member includes a biasing member such as a spring. The offset member 160 biases or rotates the actuator 140 away from a vertical axis, thus placing the magnet 130 at a height above its lowermost position. This higher position may be referred to as the rotary operating position. In this respect, the rotary 110 is allowed to rotate freely during operation without interference from the magnet 130. Preferably, offset member 160 is adapted to bias the actuator 140 at least about 5 degrees from vertical; more preferably, at least about 10 degrees from vertical; and most preferably, between about 13 degrees and 18 degrees from vertical.

The rotor locking apparatus 120 may also include a sensor 165 for preventing the premature rotation of the rotary 110. In one embodiment, the sensor 165 is adapted and arranged to determine that the carrier 135 has lowered the magnet 130. For example, the sensor 165 may be positioned to determine that the carrier 135 and the magnet 130 have reached their lowermost position. When a positive response is generated from the sensor 165, the rotary 110 is allowed to rotate. On the other hand, if the sensor 165 does not perceive that the magnet 130 is at its lowermost position, the rotary 110 is prevented from operation. In this manner, the rotary 110 may be prevented from rotation when it is open.

Figure 6:
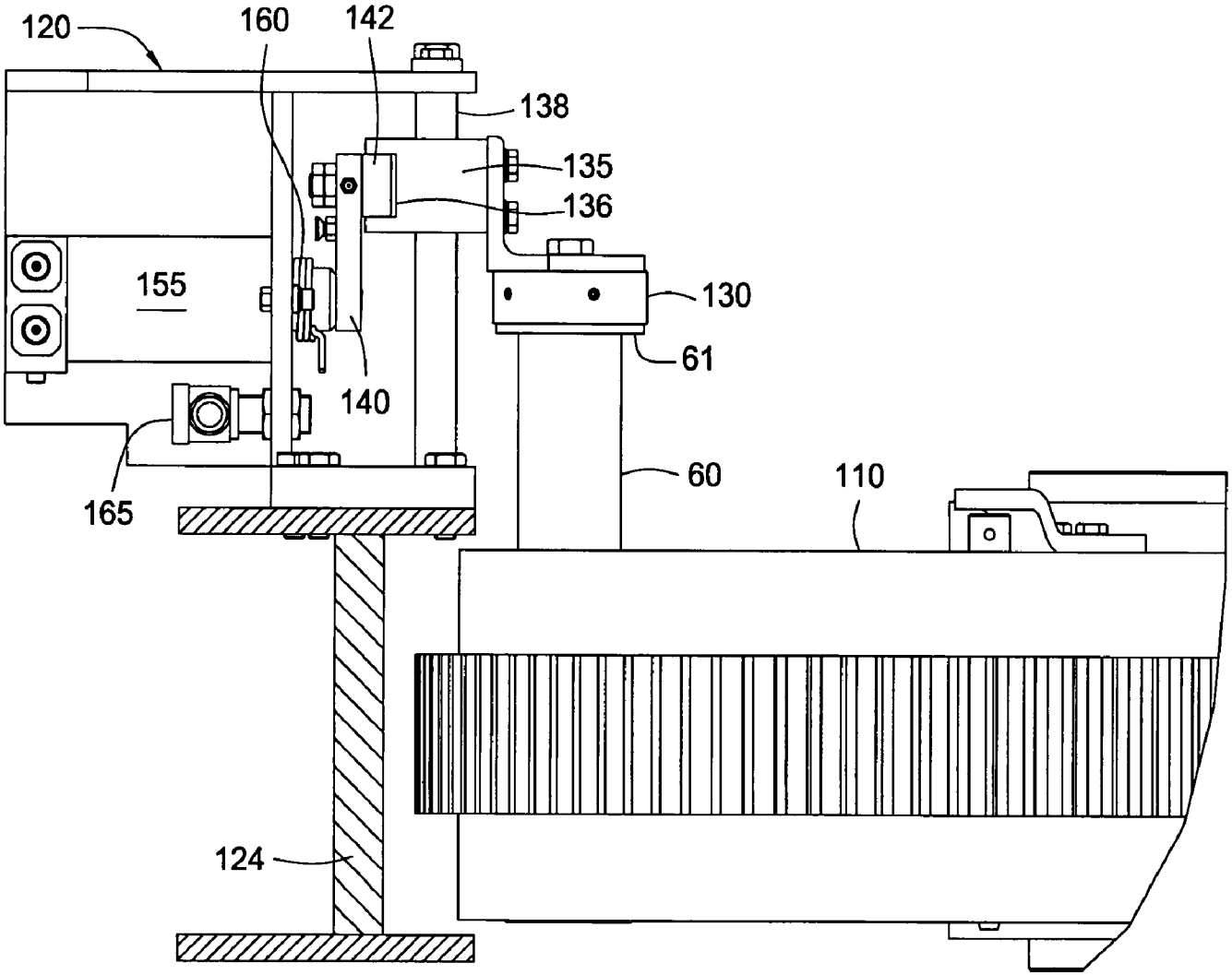
FIG. 6 shows the rotary locking apparatus of FIG. 5 in the unlocked position.
Figure 7:
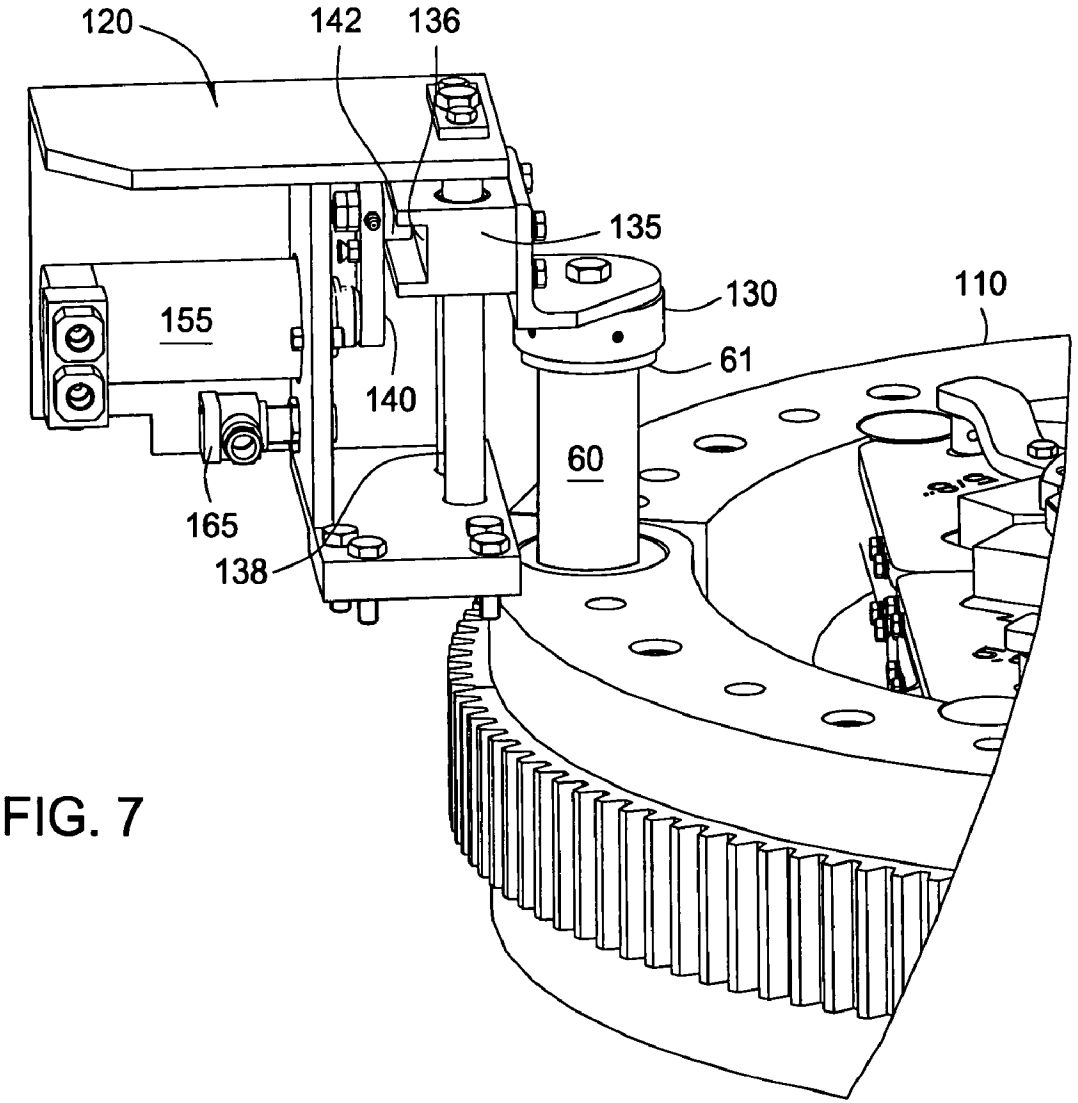
FIG. 7 is another view of the rotary locking apparatus of FIG. 5 in the unlocked position.

In operation, rotary 110 may be opened by lowering the magnet 130 into engagement with the rotor lock 60, as shown in FIG. 5. This is achieved by rotating the actuator 140 such that the roller 142 is at its lowermost position. This, in turn, places the carrier 135 and the magnet 130 in their lowermost positions. This allows the magnet 130 to magnetically engage the contact plate 61 of the rotor lock 60. To open the rotary 110, the motor 155 is activated to rotate the actuator 140. During rotation of the actuator 140, the roller 142 urges the carrier 135 upward while it moves along the slot 136 in the carrier 135. The ascent of the magnet 130 begins slowly and gradually gains speed as the actuator 140 approaches 90 degrees from the vertical. Thereafter, the magnet 130 slows down as the magnet 130 reaches its uppermost position. The magnet 130 lifts the rotor lock 60 upward until it is at least out of the aperture of the rotor extension 75, thereby unlocking the rotary 110. FIGS. 6 and 7 present different views of the rotor lock 60 in the raised position and the rotary 110 unlocked.

To lock the rotary 110, the motor 155 is activated to rotate the actuator 140 and position the roller 142 in its lowermost position. The roller 142 causes the carrier 135 and the magnet 130 to descend, thereby inserting the rotor lock 60 into the apertures of the rotor extension 75 and the rotor groove 70. FIG. 5 shows the rotor lock 60 inserted into the apertures and the rotary 110 in the locked position. Thereafter, the sensor 165 is activated to ensure that the carrier 135 is at its lowermost position. When a positive response is generated from the sensor 165, the gripping system is energized, which causes the rotor lock 60 to wedge against the rotary 110. Then the motor 155 of the rotor locking apparatus is de-energized and the rotary 110 is allowed to activate. Rotation of the rotary 110 causes the rotor lock 60 to slide off of the magnet 130. After the rotor lock 60 is freed from the magnet 130, the offset member 160 biases the actuator 140, thereby placing the magnet 130 at the rotary operating position. In this manner, the rotary 110 is allowed to freely rotate to apply torque to the tubular 5. Further, the rotary 110 is prevented from premature rotation before it is closed.

In another embodiment, an apparatus for handling a tubular includes a housing for receiving the tubular and a plurality of gripping members disposed in the housing for gripping the tubular, wherein at least one of the plurality of gripping members are pivotally coupled to the housing. In one embodiment, the apparatus also includes a plurality of torque distributors disposed in the housing for engaging the plurality of gripping members. At least one guiding element prevents the plurality of gripping members from twisting as torque is applied to the tubular. In another embodiment, the plurality of gripping members comprises an active gripping member and one or more passive gripping members. The one or more passive gripping members are adapted to react a first reaction force as a gripping force applied by the active gripping member. In another embodiment, the reactive force is directed toward the center of the tubular. In another embodiment still, two passive gripping members are utilized. In another embodiment still, the two passive gripping members are positioned less than 120 degrees apart. In another embodiment still, at least one gripping member is fluidly operated. In another embodiment still, at least one gripping member is driven by a cam. In another embodiment still, the apparatus comprises a tong. In another embodiment still, the apparatus further includes a housing locking apparatus for locking an unlocking the housing.

In another embodiment, a method for handling a tubular comprises providing a gripping apparatus having a plurality of gripping members coupled to a rotary, pivoting at least one of the plurality of gripping members relative to the rotary, gripping the tubular, and applying torque to rotate the tubular. In one embodiment, the plurality of gripping members comprises an active gripping member and one or more passive gripping members. In another embodiment, the method includes the one or more passive gripping members reacting the same amount of force as a gripping force applied by the active gripping member. In another embodiment still, the method includes fluidly operating the active gripping member. In another embodiment still, the method includes positioning two passive gripping members 120 degrees apart. In another embodiment still, the method includes positioning two passive gripping members less than 120 degrees apart. In another embodiment still, the method includes balancing the torque acting on the gripping members. In another embodiment still, the method includes directing a reaction force toward a center of the tubular. In another embodiment still, the method further includes providing the rotary with a locking member and providing a locking apparatus for moving the locking member between an open position and a closed position. In another embodiment still, the locking apparatus comprises a coupling element for engaging the locking member and an actuator for moving the coupling element. In another embodiment still, the method also includes rotating the actuator to move the locking member between the open and closed positions. In another embodiment still, the method also includes ensuring that the locking member is in the closed position prior to applying torque to rotate the tubular.

In another embodiment, an apparatus for handling a tubular includes a gripping member having a rotary and a locking member for locking the rotary. The apparatus also includes a rotary locking apparatus having a coupling element for engaging the locking member and an actuator for moving the locking member between an open position and a closed position. In another embodiment still, the apparatus also includes a carrier attached to the coupling element and coupled to the actuator. In another embodiment still, the rotation of the actuator moves the coupling element and the locking element between the open position and the closed position. In another embodiment still, the coupling element comprises a magnet. In another embodiment still, the apparatus also includes a sensor for determining a position of the locking member. In another embodiment still, the apparatus also includes an offset member for positioning the coupling element from engagement with the locking member.

While the foregoing is directed to embodiments of the present invention, other and further embodiments of the invention may be devised without departing from the basic scope thereof, and the scope thereof is determined by the claims that follow.

I claim:

1. An apparatus for handling a tubular, comprising:

an outer tong body;

a rotary disposed in the outer tong body, the rotary having:

a body; and an arm pivotally coupled to the body;

an active jaw operatively coupled to the body so that the active jaw is movable between an engaged position to grip the tubular and a disengaged position to receive the tubular, the active jaw adapted to apply a gripping force;

a passive jaw pivotally coupled to the arm, wherein the arm is movable between an open position to allow receipt of the tubular and a closed position to allow the passive jaw to grip the tubular, wherein the passive jaw is adapted to provide a reaction force substantially equivalent to the gripping force applied by the active jaw, and wherein the rotary is rotatable relative to the outer tong body to transfer torque to the tubular; and a guiding element attached to the body and in contact with the active jaw in the engaged position and in contact with the passive jaw when the arm is in the closed position, wherein the guiding element is contoured to accommodate pivotal movement of the passive jaw.

2. The apparatus of claim 1, further comprising a second arm pivotally coupled to the body and a second passive jaw pivotally coupled to the second arm, wherein the second arm is movable between an open position to allow receipt of the tubular and a closed position to allow the second passive jaw to grip the tubular.

3. The apparatus of claim 2, further comprising a second guiding element attached to the body and in contact with the active jaw in the engaged position and in contact with the second passive jaw when the arms are in the closed position.

4. The apparatus of claim 3, wherein the second guiding element is contoured to accommodate pivotal movement of the second passive jaw.

5. The apparatus of claim 1, wherein the reaction force is directed toward a center of the apparatus.

6. The apparatus of claim 1, wherein the body and the arm form a complete enclosure when the arm is in the closed position.

7. The apparatus of claim 2, wherein the two passive jaws are positioned less than 120 degrees apart.

8. The apparatus of claim 1, wherein the active jaw is fluidly operated.

9. The apparatus of claim 1, wherein an outer surface of the body and an outer surface of the arm are geared.

10. The apparatus of claim 1, further comprising a rotary locking apparatus for selectively locking the arm in the closed position.

11. The apparatus of claim 10, wherein the rotary locking apparatus comprises:

a locking member;

a coupling element for engaging the locking member; and an actuator for moving the locking member between a locked position and an unlocked position.

12. The apparatus of claim 11, further comprising a carrier attached to the coupling element and coupled to the actuator.

13. The apparatus of claim 11, wherein rotation of the actuator moves the coupling element and the locking element between the locked position and the unlocked position.

14. The apparatus of claim 3, wherein the passive jaws are in contact with each other when the arms are in the closed position.

15. An apparatus for handling a tubular, comprising:

a body;

an active jaw operatively coupled to the body so that the active jaw is movable between an engaged position to grip the tubular and a disengaged position to receive the tubular;

an arm pivotally coupled to the body;

a passive jaw pivotally coupled to the arm, wherein the arm is movable between an open position to allow receipt of the tubular and a closed position to allow the passive jaw to grip the tubular; and a rotary locking apparatus for selectively locking the arm in the closed position, the rotary having:

a locking member;

a coupling element for engaging the locking member; and an actuator for moving the locking member between a locked position and an unlocked position, wherein the coupling element comprises a magnet.

16. An apparatus for handling a tubular, comprising:

a body;

an active jaw operatively coupled to the body so that the active jaw is movable between an engaged position to grip the tubular and a disengaged position to receive the tubular;

an arm pivotally coupled to the body;

a passive jaw pivotally coupled to the arm, wherein the arm is movable between an open position to allow receipt of the tubular and a closed position to allow the passive jaw to grip the tubular; and a rotary locking apparatus for selectively locking the arm in the closed position, the rotary having:

a locking member;

a coupling element for engaging the locking member;

an actuator for moving the locking member between a locked position and an unlocked position; and a sensor for determining a position of the locking member.

17. An apparatus for handling a tubular, comprising:

a body;

an active jaw operatively coupled to the body so that the active jaw is movable between an engaged position to grip the tubular and a disengaged position to receive the tubular;

an arm pivotally coupled to the body;

a passive jaw pivotally coupled to the arm, wherein the arm is movable between an open position to allow receipt of the tubular and a closed position to allow the passive jaw to grip the tubular; and a rotary locking apparatus for selectively locking the arm in the closed position, the rotary having:

a locking member;

a coupling element for engaging the locking member;

an actuator for moving the locking member between a locked position and an unlocked position; and an offset member for positioning the coupling element away from engagement with the locking member.

18. The apparatus of claim 1, wherein the rotary includes a gear on an outer surface.

19. The apparatus of claim 1, wherein the active jaw moves into its engaged position prior to movement of the rotary.

20. An apparatus for handling a tubular, comprising:

an outer tong body;

a rotary disposed in the outer tong body, the rotary having:

a body; and an arm pivotally coupled to the body;

an active jaw operatively coupled to the body so that the active jaw is movable between an engaged position to grip the tubular and a disengaged position to receive the tubular, the active jaw adapted to apply a gripping force;

a passive jaw pivotally coupled to the arm, wherein the arm is movable between an open position to allow receipt of the tubular and a closed position to allow the passive jaw to grip the tubular, wherein the passive jaw is adapted to provide a reaction force substantially equivalent to the gripping force applied by the active jaw, and wherein the rotary is rotatable relative to the outer tong body to transfer torque to the tubular;

a second arm pivotally coupled to the body and a second passive jaw pivotally coupled to the second arm, wherein the second arm is movable between an open position to allow receipt of the tubular and a closed position to allow the second passive jaw to grip the tubular; and a first guiding element and a second guiding element, each guiding element attached to the body and in contact with the active jaw in the engaged position and in contact with a respective passive jaw when the arms are in the closed position, wherein the guiding elements are contoured to accommodate pivotal movement of the passive jaws.

21. An apparatus for handling a tubular, comprising:

an outer tong body;

a rotary disposed in the outer tong body, the rotary having:

a body; and an arm pivotally coupled to the body;

an active jaw operatively coupled to the body so that the active jaw is movable between an engaged position to grip the tubular and a disengaged position to receive the tubular, the active jaw adapted to apply a gripping force;

a passive jaw pivotally coupled to the arm, wherein the arm is movable between an open position to allow receipt of the tubular and a closed position to allow the passive jaw to grip the tubular, wherein the passive jaw is adapted to provide a reaction force substantially equivalent to the gripping force applied by the active jaw, and wherein the rotary is rotatable relative to the outer tong body to transfer torque to the tubular;

a second arm pivotally coupled to the body and a second passive jaw pivotally coupled to the second arm, wherein the second arm is movable between an open position to allow receipt of the tubular and a closed position to allow the second passive jaw to grip the tubular; and a first guiding element and a second guiding element, each guiding element attached to the body and in contact with the active jaw in the engaged position and in contact with a respective passive jaw when the arms are in the closed position, wherein the passive jaws are in contact with each other when the arms are in the closed position.

* * * * *

UNITED STATES PATENT AND TRADEMARK OFFICE

CERTIFICATE OF CORRECTION

PATENT NO. : 7,506,564 B2
APPLICATION NO. : 11/080233
DATED : March 24, 2009
INVENTOR(S) : Joerg E Schulze-Beckinghausen It is certified that error appears in the above-identified patent and that said Letters Patent is hereby corrected as shown below:

On the Title Page, In the Related U. S. Application Data Item (60):

Please insert --provisional application No. 60/554,077, filed on Mar. 17, 2004-- after Provisional application No. 60/452,270, filed on Mar. 5, 2003;

On the Title Page, Item (56):

Please insert --1,386,908 A 8/1921 Taylor--;

Please insert --1,842,638 A 1/1932 Wigle--;

Please insert --2,214,194 A 9/1940 Frankley--;

Please insert --2,214,429 A 9/1940 Miller--;

Please delete "2,566,651 A 9/1951 Bernis" and insert --2,566,651 A 9/1951 Bemis-- therefor.

Signed and Sealed this

Nineteenth Day of May, 2009

JOHN DOLL
*Acting Director of the United States Patent and Trademark Office*